US007960085B2

(12) United States Patent
Kawamura et al.

(10) Patent No.: US 7,960,085 B2
(45) **Date of Patent: *Jun. 14, 2011**

(54) METHOD FOR PRODUCING POSITIVELY CHARGEABLE TONER

(75) Inventors: Masateru Kawamura, Toyoake (JP); Jun Ikami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 675 days.

This patent is subject to a terminal disclaimer.

(21) Appl. No.: 12/023,669

(22) Filed: Jan. 31, 2008

(65) Prior Publication Data

US 2008/0182198 A1 Jul. 31, 2008

(30) Foreign Application Priority Data

Jan. 31, 2007 (JP) ..... 2007-022048

(51) Int. Cl.
*G03G 9/097* (2006.01)

(52) U.S. Cl. ..... 430/137.11; 430/108.22

(58) Field of Classification Search ..... 430/137.11, 430/137.14, 108.22
See application file for complete search history.

(56) References Cited

U.S. PATENT DOCUMENTS

| | | | | |
|---|---|---|---|---|
| 4,840,863 | A | 6/1989 | Otsu et al. | |
| 6,821,697 | B2 * | 11/2004 | Takayanagi et al. | 430/108.4 |
| 7,422,833 | B2 | 9/2008 | Niwa et al. | |
| 7,553,600 | B2 * | 6/2009 | Kawamura et al. | 430/137.14 |

FOREIGN PATENT DOCUMENTS

| | | | |
|---|---|---|---|
| JP | 63-060458 | | 3/1988 |
| JP | 03-175456 | | 7/1991 |
| JP | 03-243954 | | 10/1991 |
| JP | 10-293419 | | 11/1998 |
| JP | 11-015192 | | 1/1999 |
| JP | 2000-338723 | | 12/2000 |
| JP | 2002-108011 | A | 4/2002 |
| JP | 2006-293057 | A | 10/2006 |

OTHER PUBLICATIONS

JP Office Action dtd Nov. 13, 2008, JP Appln. 2007-022048.

* cited by examiner

*Primary Examiner* — Janis L Dote

(74) *Attorney, Agent, or Firm* — Banner & Witcoff, Ltd.

(57) ABSTRACT

A method for producing a positively chargeable toner is described. The method for producing a positively chargeable toner may include the steps of: mixing and emulsifying a charge-controlling resin having a positive polar group, an organic solvent and an aqueous medium to form an emulsion, and then removing the organic solvent from the emulsion, to thereby form a suspension of the charge-controlling resin having a positive polar group in the range of $5.0\times10^{-5}$ to $6.0\times10^{-4}$ mol/g; mixing the suspension of the charge-controlling agent with a suspension of toner base particles containing a binder resin and a colorant, to thereby form a mixture; and heating the mixture containing the suspension of the toner base particles and the suspension of the charge-controlling resin, to thereby fix the charge-controlling resin on the surfaces of the toner base particles.

5 Claims, No Drawings

METHOD FOR PRODUCING POSITIVELY CHARGEABLE TONER

CROSS REFERENCE TO RELATED APPLICATION

The present application claims priority to Japanese Patent Application No. 2007-022048, filed on Jan. 31, 2007, the disclosure of which is hereby incorporated into the present application by reference.

TECHNICAL FIELD

The present invention relates to a method for producing a positively chargeable toner which is employed in electrophotography, electrostatic recording and the like to form a visible image.

BACKGROUND

As conventional methods for producing positively chargeable toner, dry methods such as a pulverizing method, or wet methods such as a phase inversion emulsification method are known.

In the pulverizing method, a charge-controlling agent is added to a binder resin and the resulting mixture is then melt-kneaded. Therefore, a major portion of the charge-controlling agent becomes embedded in the inner portion of a particle, so that only a portion of the charge-controlling agent is exposed to the surface of the particle, thereby contributing to impart charge.

For this reason, the pulverizing method is disadvantageously less effective in imparting charge with respect to the amount of the charge-controlling agent added.

In the phase inversion emulsification method, for example, toner particles are produced by neutralizing a binder resin having a tertiary amino group to improve hydrophilicity, and emulsifying the binder resin through phase inversion in a water medium.

However, this method inevitably generates odor originating from the amino group. Further, when a charge-controlling agent is added before phase inversion, and the resulting mixture is then emulsified through phase inversion, the same disadvantage exists that a major portion of the charge-controlling agent becomes embedded in the inner portion of a particle, so that only a portion of the charge-controlling agent is exposed to the surface of the particle. In addition, when an ionic group such as a tertiary amino group is contained, there is a disadvantage that particles are poorly formed during phase-inversion emulsification.

To cope with these disadvantages, there has been proposed a method for producing a toner in the following procedure. For example, a mixture of a basic group-containing resin which becomes self-dispersible and/or soluble in water through neutralization and a positively chargeable charge-controlling agent as essential components are emulsified through phase inversion into a water medium under the presence of a neutralizing agent, to thereby prepare an aqueous dispersion and/or aqueous solution of fine particles. Then, the aqueous dispersion and/or aqueous solution of the fine particles are mixed with an aqueous dispersion of toner particles having a colorant and a binder resin as essential components, and the basic group-containing resin containing a positively-chargeable controlling agent is deposited on the surfaces of the toner particles using a neutralizing agent having a polarity opposite to that of the aforementioned neutralizing agent. By doing this, the basic group-containing resin containing the positively-chargeable controlling agent is fixed on the surfaces of the toner particles, to thereby produce a toner.

There has been proposed another method for producing a spherical toner having positively-charging characteristics in the following procedure. For example, an aqueous dispersion of resin particles having a binder resin and a colorant as essential components, and a separately-prepared aqueous dispersion of basic group-containing resin microparticles having carbon black as an essential component are mixed to thereby deposit fine particles on the surfaces of the resin particles. After drying of the resin particles, the particles are mixed with stirring to make the surfaces of the toner particles stable and uniform, and negative-charging, inorganic microparticles are externally added to the toner particles, whereby a spherical toner is produced.

SUMMARY

In the former proposed method, toners in which the basic group-containing resin containing a small amount of positively chargeable charge-controlling agent is uniformly fixed on the surfaces of the toner particles can be obtained. There is, however, a disadvantage that the toner obtained by this method cannot achieve satisfactory charge rising performance.

In the latter proposed method, a positively chargeable toner in which negative-charging, inorganic microparticles are externally added to the toner particles obtained by fixing the basic group-containing resin containing carbon black as an essential component on the surfaces of the resin particles can be obtained. There is, however, a disadvantage that the toner obtained by this method has insufficient chargeability, thereby causing fog.

One aspect of the present invention may provide a method for producing a positively chargeable toner showing good charge rising performance, and capable of securing sufficient chargeability to reduce fog.

The same or different aspect of the present invention may provide a method for producing a positively chargeable toner including the steps of: mixing and emulsifying a charge-controlling resin having a positive polar group, an organic solvent and an aqueous medium to form an emulsion, and then removing the organic solvent from the emulsion, to thereby form a suspension of the charge-controlling resin having a positive polar group in the range of $5.0\times10^{-5}$ to $6.0\times10^{-4}$ mol/g; mixing the suspension of the charge-controlling agent with a suspension of toner base particles containing a binder resin and a colorant, to thereby form a mixture; and heating the mixture containing the suspension of the toner base particles and the suspension of the charge-controlling resin, to thereby fix the charge-controlling resin on the surfaces of the toner base particles.

DETAILED DESCRIPTION

1) Step of Preparing a Suspension

According to the method of producing a positively chargeable toner of the present invention, first, a charge-controlling resin having a positive polar group, an organic solvent, and an aqueous medium are mixed and emulsified to form an emulsion, and the organic solvent is then removed from the emulsion, to thereby form a suspension of the charge-controlling resin having the positive polar group in the range of $5.0\times10^{-5}$ to $6.0\times10^{-4}$ mol/g.

To form an emulsion, a charge-controlling resin having a positive polar group, an organic solvent, and an aqueous medium are mixed, and the mixture is emulsified.

(Charge-Controlling Resin Having a Positive Polar Group)

The charge-controlling resin having a positive polar group is a synthetic resin having a cationic group, which is mixed in order to consistently impart positive chargeability to a toner. A synthetic resin is capable of being satisfactorily fixed on the toner base particles described later.

Examples of the cationic group include a quaternary ammonium group, a quaternary ammonium salt-containing group, an amino group, and a phosphonium salt-containing group. The cationic group is preferably a quaternary ammonium salt-containing group. When the cationic group is a quaternary ammonium salt-containing group, the charge-controlling resin can be stably emulsified, thereby allowing to improve charging stability of the obtained toner.

Further, examples of the synthetic resin include an acrylic resin, an acryl-styrene resin, a polystyrene resin, and a polyester resin. The synthetic resin is preferably an acrylic resin or an acryl-styrene resin. These resins can be used alone or in combination.

The synthetic resin having a cationic group can be obtained, for example, by copolymerizing polymerizable monomers having a cationic group (cationic group-containing vinyl monomers) and polymerizable monomers which are copolymerizable with the polymerizable monomers having a cationic group (copolymerizable vinyl monomers). For example, the acrylic resin or the acryl-styrene resin can be obtained by radical copolymerization of (meth)acrylate having a cationic group, and (meth)acrylate or styrene which is copolymerizable therewith.

In the above method, if desired, the synthetic resin having a cationic group can also be cross-linked by copolymerizing polyfunctional polymerizable monomers such as poly(di-, tri-, or tetra-)acrylate, or divinylbenzene as copolymerizable vinyl monomers.

In the synthetic resin having a cationic group obtained by the above method, the content amount of the positive polar group in the charge-controlling resin can be arbitrarily adjusted by appropriately selecting the amount of the cationic group-containing vinyl monomer to be mixed. In this case, the amount of the mixed cationic group-containing vinyl monomer is, in the range of, for example, 5 to 50% by weight, or preferably 10 to 40% by weight, based on the total amount of all the polymerizable monomers.

The charge-controlling resin containing a quaternary ammonium salt-containing group can be produced according to the descriptions of Japanese Unexamined Patent Publication No. 63-60458, Japanese Unexamined Patent Publication No. 03-175456, Japanese Unexamined Patent Publication No. 03-243954, Japanese Unexamined Patent Publication No. 11-15192, etc. Examples of the charge-controlling resin containing a quaternary ammonium salt-containing group include the trade name FCA-207P (synthetic resin (styrene: 83% by weight, butyl acrylate: 15% by weight, and N,N-diethyl-N-methyl-2-(methacryloyloxy) ethylammonium=p-toluenesulfonate: 2% by weight) having a weight-average molecular weight (Mw) of 12,000 and a glass transition temperature (Tg) of 67° C.; manufactured by Fujikura Kasei Co., Ltd.), the trade name FCA-161P (product of the same company), the trade name FCA-78P (product of the same company), and the trade name FCA-201PS (product of the same company).

The smaller the particle of the charge-controlling resin is, the more uniformly the charge-controlling resin can be deposited on the surfaces of the toner base particles. Therefore, the charge-controlling resin is prepared in extremely smaller microparticles than the toner base particles. For example, when the toner base particle has a volume-average particle size of, for example, 3 to 12 μm, or preferably 6 to 10 μm, as a median size, the charge-controlling resin has a volume-average particle size of, for example, 30 to 500 nm, or preferably 50 to 300 nm, as a median size.

The weight-average molecular weight (Mw) of the charge-controlling resin is preferably set in the range of 3000 to 100,000. When the weight-average molecular weight (Mw) is less than 3000, the charge-controlling resin may have poor strength, and toner particles may be aggregated. On the other hand, when the weight-average molecular weight (Mw) is in excess of 100,000, the charge-controlling resin may become excessively hard and impair fixation performance in some cases. It should be noted that the weight-average molecular weight (Mw) is calculated as a standard polystyrene-based value by GPC measurement.

The glass transition temperature (Tg) of the charge-controlling resin is set in the range of 40° C. to 100° C. from the viewpoint of storage stability or thermal fixation of the toner. The charge-controlling resin has more preferably a glass transition temperature of 55° C. to 80° C.

(Organic Solvent)

No particular limitation is imposed on the organic solvent as long as the charge-controlling resin can be dissolved in or swollen with the organic solvent, and a known organic solvent may be employed. The organic solvent preferably has a certain degree of water solubility so that the dissociation of the counter ions of the charge-controlling resin can be accelerated during emulsification with an aqueous medium. Examples of such organic solvent include ethyl acetate, methyl ethyl ketone (MEK), tetrahydrofuran (THF), and acetone. These can be used alone or in combination.

(Aqueous Medium)

The aqueous medium is water, or a water medium containing water as a predominant component in which some water-soluble solvent (e.g., alcohols and glycols) or an additive (e.g., a surfactant, a dispersing agent) is mixed. According to the following emulsification method, the aqueous medium preferably employs water only.

(Preparation of the Emulsion)

The emulsion can be prepared in the following procedure. For example, a charge-controlling resin having a positive polar group is mixed with an organic solvent to prepare a mixture of the charge-controlling resin with the organic solvent in which the charge-controlling resin is dissolved in or swollen with the organic solvent. Subsequently, the mixture of the charge-controlling resin with the organic solvent is emulsified in an aqueous medium, to thereby form an emulsion.

First, a charge-controlling resin is mixed with an organic solvent, for example, at a mixing ratio of 5 to 100 parts by weight, or preferably 10 to 50 parts by weight of the charge-controlling resin, based on 100 parts by weight of the organic solvent.

No particular limitation is imposed on the mixing method. For example, the charge-controlling resin is added to an organic solvent, and then mixed with stirring so that the charge-controlling resin is dissolved therein or swollen therewith. Thus, the mixture of the charge-controlling resin with the organic solvent, in which the charge-controlling resin is dissolved in or swollen with the organic solvent, is prepared.

Next, the mixture of the charge-controlling resin with the organic solvent is emulsified in an aqueous medium, for example, by adding the mixture of the charge-controlling resin with the organic solvent to an aqueous medium at a mixing ratio of 50 to 150 parts by weight, or preferably 80 to 100 parts by weight of the mixture of the charge-controlling resin with the organic solvent, based on 100 parts by weight of the aqueous medium.

Thereafter, the aqueous medium mixed with the mixture of the charge-controlling resin with the organic solvent is agitated using a known dispersing apparatus, etc. For example, in the case of using a 1 to 3 L vessel, high-speed dispersing apparatus such as a homogenizer is employed and, the agitation is performed at a rotation speed of 5000 to 20000 rpm (tip circumferential velocity of 4 to 17 m/s), or preferably 8000 to 16000 rpm (tip circumferential velocity of 7 to 14 m/s), for 5 to 60 minutes, or preferably for 10 to 30 minutes. Then, the mixture of the charge-controlling resin with the organic solvent becomes liquid droplets to be emulsified in an aqueous medium, so that an emulsion is prepared.

Alternatively, the emulsion can be prepared in the following procedure. An aqueous medium and an organic solvent are mixed, for example, at a mixing ratio of 4 to 140 parts by weight, or preferably 60 to 90 parts by weight of the organic solvent, based on 100 parts by weight of the aqueous medium. Thereafter, a charge-controlling resin is mixed with the mixture of the aqueous medium and the organic solvent, for example, at a mixing ratio of 2 to 50 parts by weight, or preferably 5 to 25 parts by weight, of the charge-controlling resin, based on the 100 parts by weight of the mixture, and is then agitated in the same manner as above, so that an emulsion is prepared.

In the preparation of such emulsion, since the charge-controlling resin has a positive polar group, the charge-controlling resin can be satisfactorily emulsified without mixing an emulsion stabilizer (e.g., a surfactant, a dispersing agent, or a neutralizing agent). This can therefore prevent an emulsion stabilizer which inhibits charging stability of the toner from depositing on the surface of the toner, and the obtained toner can be stably charged.

(Preparation of the Suspension)

To obtain a suspension, the organic solvent is removed from the emulsion.

To remove the organic solvent from the emulsion, a known method such as ventilation, heating, decompression, or combination thereof is employed. For example, the emulsion is heated under inert gas atmosphere, for example, at a temperature of room temperature to 90° C., or preferably 50 to 80° C., until about 80 to 95% by weight of the early amount of the organic solvent is removed. The organic solvent is then removed from the aqueous medium, so that a suspension (slurry) having microparticles of the charge-controlling resin dispersed in the aqueous medium is prepared.

At this time, the charge-controlling resin dispersed in the aqueous medium is adjusted so as to have an amount of the positive polar group existing on the surface of the charge-controlling resin (microparticles) in the range of $5.0\times10^{-5}$ to $6.0\times10^{-4}$ mol/g, or preferably $1.0\times10^{-4}$ to $2.0\times10^{-4}$ mol/g.

When the amount of the positive polar group is lower than this range, the toner is insufficiently charged, which causes poor image formation. On the contrary, when the amount thereof is higher than this range, the amount of the toner to be developed on a photosensitive member decreases, thereby failing to attain sufficient concentration. In addition, in a contact development method in which a photosensitive member and a developing roller are in contact by pressure, the charging is excessively high, which causes fog by pressure. When the amount falls within the above range, therefore, appropriate charging ability can be imparted to the toner, thereby enabling improvement in charge rising performance and charging stability with time. Further, sufficient chargeability can be secured, thereby resulting in reduction of fog.

The amount of the positive polar group can be determined, for example, by a colloidal titration method (a streaming potential method).

The amount of the positive polar group can be set within the above range by controlling the composition ratio of the charge-controlling resin which is a raw material (e.g., composition ratio of a cationic group-containing vinyl monomer and a copolymerizable vinyl monomer, i.e., the mixing amount of a cationic group-containing vinyl monomer with respect to the total amount of all the polymerizable monomers), and the volume-average particle size of the charge-controlling resin (microparticles) when dispersed in an aqueous medium.

For example, when the amount of the mixed cationic group-containing vinyl monomer is 14% by weight, if the volume-average particle size of the microparticles is in the range of, for example, 60 to 200 nm as a median size, the amount of the positive polar group can be set within the above range.

Alternatively, for example, when the amount of the cationic group-containing vinyl monomer is 28% by weight, if the volume-average particle size of the microparticles is in the range of, for example, 110 to 300 nm as a median size, the amount of the positive polar group can be set within the above range.

The volume-average particle size of the microparticles can be set within the above range by properly controlling the viscosity of the charge-controlling resin when mixed with an organic solvent, the mixing ratio of the mixture of the charge-controlling resin with the organic solvent with respect to water, and the agitation rate of the aqueous medium mixed with the mixture of the charge-controlling resin with the organic solvent.

With regard to the setting of the amount of the positive polar group in the above range, the mixing amount of the cationic group-containing vinyl monomer with respect to the total amount of all the polymerizable monomers are in the range of preferably 10 to 40% by weight, or more preferably 10 to 30% by weight.

In addition, with regard to the setting of the amount of the positive polar group in the above range, the mixing ratio of the charge-controlling resin, the organic solvent, and water is preferably 4 to 100 parts by weight or more preferably 10 to 50 parts by weight of the charge-controlling resin, and preferably 40 to 140 parts by weight or more preferably 60 to 90 parts by weight of the organic solvent, based on 100 parts by weight of water.

Further, with regard to the setting of the amount of the positive polar group in the above range, the volume-average particle size of the microparticles is preferably 30 to 500 nm, or more preferably 50 to 300 nm, as a median size.

The charge-controlling resin may be aggregated to bury the positive polar group into the aggregates even by the method of emulsifying the mixture of the charge-controlling resin with the organic solvent in an aqueous medium or the method of removing the organic solvent. For this reason, the setting of the amount of the positive polar group in the above range may also involve such methods. A preferred method of setting the amount of the positive polar group in the above range is as described above.

In this method, since the charge-controlling agent has a positive polar group, the charge-controlling agent dissolved in or swollen with the organic solvent is usually stably emulsified in the aqueous medium during preparation of the emulsion. Then, the suspension is obtained by removing the organic solvent from the resulting emulsion, so that the suspension is usually prepared as a suspension of the charge-controlling agent having microparticles with less aggregates.

2) Step of Mixing the Suspension of Toner Base Particles and the Suspension of Charge-Controlling Agent According to the method of producing a positively chargeable toner of the present invention, next, the suspension of the toner base particles and the suspension of the charge-controlling agent are mixed together.

(Toner Base Particle)

The toner base particle contains a binder resin and a colorant.

(Binder Resin)

The binder resin is a predominant component of the toner and is made of a synthetic resin which fixes (heat-seals) on the surface of a recording medium (paper, an OHP sheet, etc.) by heating and/or pressurizing.

No particular limitation is imposed on the type of the binder resin. A known synthetic resin which is known as a binder resin for toners may be employed. Examples of the binder resin include polyester resin, styrene resin (e.g., styrene such as polystyrene, poly-p-chlorostyrene and polyvinyltoluene, or its derivative; e.g., styrene-styrene derivative copolymers such as styrene-p-chlorostyrene copolymer and styrene-vinyltoluene copolymer; e.g., styrene copolymers such as styrene-vinylnaphthalene copolymer, styrene-acrylic acid-based copolymer, styrene-methacrylic acid-based copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer), and other resins such as acrylic resin, methacrylic resin, polyvinyl chloride resin, phenolic resin, naturally modified phenolic resin, natural resin-modified maleic acid resin, polyvinyl acetate resin, silicone resin, polyurethane resin, polyamide resin, furan resin, epoxy resin, polyvinyl butyral resin, terpene resin, coumarone-indene resin, and petroleum resin. These resins can be used alone or in combination.

When a toner for full-color printing is provided, the binder resin is required to be transparent, to be substantially colorless in such a degree that color tone of the toner image is not affected, to have excellent compatibility with the charge-controlling resin, to have flowability under appropriate thermal or pressure conditions, and to be capable of being formed into microparticles. From these viewpoints, polyester resin, styrene resin, and acrylic resin are preferred. Particularly, polyester resin is more preferred from the viewpoint of the balance between thermal fixation and strength. The use of polyester resin can improve low-temperature fixation of the toner. Charging characteristics of polyester resin tends to vary by moisture. However, according to the method of producing a positively chargeable toner of the present invention, even if polyester resin is employed as a binder resin, the charging characteristics of the positively chargeable toner can be stable.

(Colorant)

The colorant is a substance for imparting a desired color to the toner, and is incorporated into the binder resin through dispersion or permeation. As the colorant, for example, carbon black is employed. In addition, examples of the colorant include organic pigments such as Quinophthalone Yellow, Hansa Yellow, Isoindolinone Yellow, Benzidine Yellow, Perynone Orange, Perynone Red, Perylene Maroon, Rhodamine 6G Lake, Quinacridone Red, Rose Bengal, Copper Phthalocyanine Blue, Copper Phthalocyanine Green, and a diketopyrrolopyrole pigment; inorganic pigments and metal powders such as Titanium White, Titanium Yellow, ultramarine, Cobalt Blue, red iron oxide, aluminum powder, and bronze; oil-soluble dyes and dispersion dyes such as azo dyes, quinophthalone dyes, anthraquinone dyes, xanthene dyes, triphenylmethane dyes, phthalocyanine dyes, indophenol dyes, and indoaniline dyes; and rosin dyes such as rosin, rosin-modified phenol, and rosin-modified maleic acid resin. Further, other dyes and pigments treated with higher fatty acid or resin may be used. These can be used alone or in combination corresponding to a desired color. For example, when a mono-chromatic color toner is provided, the colorant can be prepared by mixing a pigment and a dye of the same color, such as rhodamine pigment and dye, quinophthalone pigment and dye, or phthalocyanine pigment and dye.

The colorant is mixed at a ratio of, for example, 2 to 20 parts by weight, or preferably 4 to 10 parts by weight, based on 100 parts by weight of the binder resin.

(Releasing Agent)

The toner base particle further contains a known additive such as a releasing agent as needed.

A releasing agent is added in order to improve the fixation of the toner to a recording medium.

No particular limitation is imposed on the releasing agent, and a known releasing agent is employed. Examples of the releasing agent include polyolefin waxes such as low-molecular weight polyethylene, low-molecular weight polypropylene, and low-molecular weight polybutylene; plant-derived natural waxes such as candelilla wax, carnauba wax, rice wax, Japan wax, and Jojoba wax; petroleum waxes such as paraffin, microcrystalline and petrolatum, and modified waxes thereof; synthetic waxes such as Fischer-Tropsch wax; and polyfunctional ester compounds such as pentaerythritol tetramyristate, pentaerythritol tetrapalmitate, and dipentaerythritol hexapalmitate. These releasing agents can be used alone or in combination.

The releasing agent is mixed at a ratio of, for example, 1 to 20 parts by weight, or preferably 3 to 10 parts by weight, based on 100 parts by weight of the binder resin.

(Preparation of the Suspension of Toner Base Particles)

No particular limitation is imposed on the preparation of the toner base particles. The toner base particles can be prepared by a known method such as pulverization, suspension polymerization, emulsion polymerization, emulsion polymerization aggregation, or a dissolution suspension method (emulsion dispersion or drying in liquid).

The toner base particles preferably have a surface potential with a negative polarity while suspended in an aqueous medium. If the toner base particles have a negative polarity, the microparticles of the charge-controlling agent can be firmly and uniformly fixed on the toner base particles electrostatically. Thus, formation of toner particles having an opposite polarity that would otherwise be formed can be effectively prevented. To make the polarity of the surface potential of the toner base particles negative, for example, a polyester resin having an acid group is used as a binder resin.

To the toner base particles, a basic dye such as a Nigrosine dye or a triarylmethane dye, which exhibits high charging performance as a positively chargeable charge-controlling agent, can be added. In the case where such basic dye is added, the charge-controlling dye and the aforementioned charge-controlling resin are used in combination.

To prepare the suspension of toner base particles, for example, in the case of toner base particles made of polyester resin, the following method is preferred. A polyester resin having an acid group is dissolved in an organic solvent or melted only by heat. Thereafter, the polyester resin is mixed with a basic aqueous solution to thereby emulsify the mixture in water. Thus, the resulting microparticles are prepared and then aggregated.

Alternatively, the suspension of toner base particles can be prepared, for example, by directly mixing toner base particles in an aqueous medium, and forcibly dispersing the mixture with a dispersing apparatus.

The amount of the toner base particles dispersed in the aqueous medium is in the range of, for example, 5 to 50% by weight, or preferably 10 to 30% by weight, as a solid content in the suspension (concentration of the toner base particles in the suspension). The toner base particles dispersed in the aqueous medium have a volume average particle size of, for example, 3 to 12 μm, or preferably 6 to 10 μm, as a median size.

(Mixing of the Suspension of the Toner Base Particles with the Suspension of the Charge-Controlling Agent)

No particular limitation is imposed on the method of mixing the suspension of the toner base particles with the suspension of the charge-controlling agent. For example, the suspension of the charge-controlling agent is mixed with the suspension of the toner base particles, and the mixture is appropriately agitated.

The suspension of the charge-controlling agent is mixed with the suspension of the toner base particles so as to have a solid content (i.e., the charge-controlling agent) in the range of, for example, 0.1 to 5 parts by weight, or preferably 0.5 to 3 parts by weight, based on 100 parts by weight of the solid content (i.e., the toner base particles) in the suspension of the toner base particles.

The suspension may be agitated to mix, for example, with an agitator such as a three-one motor to an extent that the entire liquid flows. Known agitating blades such as flat turbine blades, propeller blades, or anchor blades can be used. A high-speed dispersing apparatus such as a homogenizer can also be used. Further, an ultrasonic dispersing apparatus is preferably used from the viewpoint of uniform dispersion.

Since the charge-controlling agent microparticles with less aggregation are suspended in the suspension of the charge-controlling agent as described above, the toner base particles and the charge-controlling agent are uniformly suspended in the mixture containing the suspension of the toner base particles and the suspension of the charge-controlling agent.

3) Step of Fixing the Charge-Controlling Resin on the Surfaces of the Toner Base Particles According to the method of producing a positively chargeable toner of the present invention, next, the charge-controlling resin is fixed on the surfaces of the toner base particles by heating the mixture containing the suspension of the toner base particles and the suspension of the charge-controlling resin.

No particular limitation is imposed on the method of heating the mixture. For example, when the toner base particles have a lower Tg (glass transition point) than the charge-controlling resin, the mixture is heated at a temperature in the range of 0 to 5° C. higher than the Tg of the toner base particles for 10 to 60 minutes. On the contrary, when the toner base particles have a higher Tg than the charge-controlling resin, the mixture is heated at a temperature in the range of 0 to 5° C. higher than the Tg of the charge-controlling resin for 10 to 60 minutes.

In the fixing step, if the charge-controlling resin microparticles that are fixed on the surfaces of the toner base particles are softened, the toner thus obtained can be prepared as a micro capsule toner in which the toner base particles are encapsulated by the charge-controlling resin. Alternatively, when the toner base particles have a lower Tg (glass transition point) than the charge-controlling resin, if the toner base particles are softened during heating, the charge-controlling resin microparticles can be embedded in the surfaces of the toner base particles.

The pH of the mixture during heating is preferably adjusted, for example, by adding a pH adjusting agent such as alkali metal salt so that the mixture has a pH of, for example, 6 to 10.5, or further a pH of 6 to 8. Alternatively, the pH adjusting agent can be previously added to the suspension of the toner base particles.

Thus, the charge-controlling resin is fixed on the surfaces of the toner base particles, and a positively chargeable toner can be obtained.

In such toner, as described above, the toner base particles and the charge-controlling agent are uniformly suspended in the mixture, so that the charge-controlling resin is uniformly fixed on the surfaces of the toner base particles. Therefore, the toner thus obtained can be stably charged.

Thereafter, the toner is cooled and then filtered to dry. The amount of the charge-controlling resin fixed on the surfaces of the toner base particles can be calculated from the solid content of the suspension of the charge-controlling agent during mixing and the solid content of the filtrate (the charge-controlling agent in the filtrate).

The amount of the fixed charge-controlling resin is in the range of, for example, 0.2 to 5 parts by weight, or preferably 0.2 to 3 parts by weight, based on 100 parts by weight of the toner base particles. When the fixed amount is less than this range, the charge-controlling agent is insufficiently fixed on the surfaces of the toner base particles, so that sufficient chargeability may not be secured. On the contrary, when the fixed amount is more than this range, charge-up or other problems can be caused, which deteriorates the charging uniformity of the toner, resulting in the reduction of the charging stability of the toner. Therefore, the toner can be further stably charged in the above range.

4) Post Treatment Step (Addition of External Additive(s))

Thereafter, if desired, an external additive is added to the toner. The external additive is added in order to adjust charging characteristics, flowability, storage stability, etc., of the toner, and is in the form of ultra-microparticles considerably smaller than the toner base particles.

Examples of the external additive include inorganic particles and synthetic resin particles.

Examples of the inorganic particles include silica, aluminum oxide, titanium oxide, silicon aluminium cooxide, silicon titanium cooxide, and a hydrophobicized product thereof. For example, a hydrophobicized product of silica can be obtained under hydrophobicizing treatment of silica micropowder using silicone oil or a silane coupling agent (e.g., dichlorodimethylsilane, hexamethyldisilazane, tetramethyldisilazane, etc.).

Examples of the synthetic resin particles include methacrylate ester polymer particles, acrylic ester polymer particles, styrene-methacrylate ester copolymer particles, styrene-acrylate ester copolymer particles, and core-shell particles (core: styrene polymer, shell: methacrylate ester polymer).

No particular limitation is imposed on the method of adding the external additive(s). For example, the toner obtained by the above method and the external additive(s) are mixed with stirring using a high-speed agitator such as a HENSCHEL MIXER. No particular limitation is imposed on the amount of the external additive(s). The amount is generally 0.1 to 6 parts by weight based on 100 parts by weight of the toner obtained by the above method.

5) Positively Chargeable Toner

The toner obtained by the above method is a positively-chargeable, non-magnetic single-component toner containing toner base particles, a charge-controlling resin, and if desired, an external additive. The toner has a volume-average particle size of, for example, 3 to 12 μm, or preferably 6 to 10 μm, as a median size. The toner also has a CV value in the range of 15 to 35%, or preferably 15 to 25%, a degree of dispersion in the range of 1.10 to 1.30, or preferably 1.10 to 1.25, and an average circularity in the range of 0.90 to 1.00, or preferably 0.98 to 1.00. It should be noted that the aforementioned degree of dispersion is an index of the sharpness of distribution and is calculated from the volume average diameter/number average diameter.

Such positively chargeable toner shows good charge rising performance, and capable of securing sufficient chargeability to reduce fog.

EXAMPLES

The method of producing a positively chargeable toner will now be more particularly described by reference to the following examples. In the following description, the units "part(s)" and "%" are by weight, unless otherwise noted.

1) Preparation of Charge-Controlling Resin (Preparation of Charge-Controlling Resin A)

225 parts of styrene monomers, 15 parts of acrylic monomers (methyl chloride quaternary salt of dimethylaminoethyl methacrylate (ACRYESTER DMC; manufactured by Mitsubishi Rayon Co., Ltd.)), 30 parts of butyl acetate, 5 parts of an azo polymerization initiator (V65; manufactured by Wako Pure Chemical Industries, Ltd.), 50 parts of MEK (methyl ethyl ketone), and 150 parts of methanol were charged to a 1 L separable flask.

Subsequently, nitrogen gas was blown into the flask at a flow rate of 50 ml/min to bubble the charged mixture for 30 minutes. Then, while the gas was further blown to a gas phase portion therein at a flow rate of 30 ml/min, the separable flask was heated to 65° C.

Thereafter, the heated mixture was subjected to solution polymerization for about 10 hours while agitated using a meniscoid-form impeller at a rotation speed of 100 rpm. The resin solution thus obtained was heated under reduced pressure to remove the solvent, whereby a charge-controlling resin A made of acryl-styrene resin containing a quaternary ammonium salt-containing group was formed.

The charge-controlling resin A had a weight-average molecular weight (Mw) of 12000, and a glass transition temperature (Tg) of 65° C.

The glass transition temperature (Tg) was determined using a differential scanning calorimeter (DSC6220; manufactured by SII NanoTechnology Inc.). In particular, 5 mg of a sample was put in a dedicated aluminum pan and then heated from a temperature of −10° C. to 170° C. at 10° C./min (1st run). Subsequently, the heated sample was cooled at 50° C./min, and thereafter, the cooled sample was again heated from a temperature of −10° C. to 170° C. (2nd run). As a reference, 9.7 mg of an aluminum plate was put in the same aluminum pan. The median glass transition temperature in the 2nd run was employed as the Tg of the charge-controlling resin A.

(Preparation of Charge-Controlling Resins B to D)

Other than the aforementioned charge-controlling resin, a charge-controlling resin B (under the trade name of "FCA-161P", manufactured by Fujikura Kasei Co., Ltd.), a charge-controlling resin C (under the trade name of "FCA-78P", manufactured by Fujikura Kasei Co., Ltd.), and a charge-controlling resin D (under the trade name of "FCA-201PS", manufactured by Fujikura Kasei Co., Ltd.) were provided.

The charge-controlling resin B is a copolymer of butyl acrylate, N,N-diethyl-N-methyl-2-(methacryloyloxy) ethylammonium=p-toluenesulfonate, and styrene (content of N,N-diethyl-N-methyl-2-(methacryloyloxy) ethylammonium=p-toluenesulfonate: 7% by weight), and has a weight-average molecular weight (Mw) of 10000 and a glass transition temperature (Tg) of 58° C.

The charge-controlling resin C is a copolymer of butyl acrylate, N,N-diethyl-N-methyl-2-(methacryloyloxy) ethylammonium=p-toluenesulfonate, and styrene (content of N,N-diethyl-N-methyl-2-(methacryloyloxy) ethylammonium=p-toluenesulfonate: 28% by weight), and has a weight-average molecular weight (Mw) of 13000 and a glass transition temperature (Tg) of 72° C.

The charge-controlling resin D is a copolymer of butyl acrylate, N,N-diethyl-N-methyl-2-(methacryloyloxy) ethylammonium=p-toluenesulfonate, and styrene (content of N,N-diethyl-N-methyl-2-(methacryloyloxy) ethylammonium=p-toluenesulfonate: 14% by weight), and has a weight-average molecular weight (Mw) of 15000 and a glass transition temperature (Tg) of 66° C.

2) Preparation of the Suspension of the Charge-Controlling Resin (Hereinafter Referred to as Charge Suspension)

(Preparation of Charge Suspension A)

82.5 parts of MEK and 17.5 parts of the charge-controlling resin A were mixed with stirring, and the charge-controlling resin A was dissolved in the MEK, to thereby form a resin solution.

The resin solution was then mixed with 100 parts of distilled water, and the mixture was agitated using a homogenizer (a rotor-stator type, shaft 18F, rotor diameter: 12.5 mm, DIAX-900 manufactured by Heidolph Instruments; the same applies to the following) at a rotation speed of 16000 rpm (tip circumferential velocity of 10.5 m/s) for 20 minutes to emulsify the mixture. The obtained emulsion was transferred to a 1 L separable flask, and while nitrogen was blown into the gas phase, the content of the flask was heated with stirring at 60° C. for 45 minutes to remove the MEK, whereby a charge suspension A was formed.

The charge suspension A thus obtained was found to have a solid content of 20.4%, the charge-controlling resin (microparticles) was found to have a volume-average particle size of 143 nm as a median size, and the volume of the quaternary ammonium salt-containing group (the volume of the positive polar group) existing on the surface of the charge-controlling resin (microparticles) was found to be $1.5\times10^{-4}$ mol/g.

The volume-average particle size and the volume of the quaternary ammonium salt-containing group were determined as follows. The following charge suspensions were determined in the same manner.

Volume-average particle size: A Microtrac particle size analyzer (UPA150; manufactured by Nikkiso Co., Ltd.) was used. Pure water was employed as dilution solvent. The refractive index of the solvent and that of the dispersion were set to 1.33 and 1.51, respectively, and the same sample was then measured 3 times to thereby obtain the average value as an average median size.

Volume of quaternary ammonium salt-containing group: The following colloidal titration (streaming potential measurement) was performed.

1) Measurement Condition

As a streaming potential measuring apparatus, an Automatic Potentiometric Titrator AT-510 (manufactured by Kyoto Electronics Manufacturing Co., Ltd.) and a Particle Charge Detector PCD-500 (manufactured by Kyoto Electronics Manufacturing Co., Ltd.) were provided.

An aqueous solution of sodium dodecyl sulfate (sodium lauryl sulfate; manufactured by Wako Pure Chemical Industries, Ltd.) was prepared as a titrating reagent for colloidal titration. The solution had a concentration of 0.004 mol/L.

2) Preparation of Sample

A charge suspension was diluted with distilled water so as to have a solid content of 0.1%, and 100 g of the 0.1% charge suspension was provided in a beaker.

3) Measurement of Sample

The titrating reagent was put in the aforementioned streaming potential measuring apparatus and then gradually added dropwise to the provided 0.1% charge suspension to determine a streaming potential. A point of inflection of the streaming potential was considered as a titration point. The volume of the positive polar group (the volume of the quaternary ammonium salt-containing group) in the charge suspension was calculated from the volume of the titrating reagent added dropwise up to the titrating point.

(Preparation of Charge Suspension B)

80 parts of MEK and 20 parts of the charge-controlling resin A were mixed with stirring, and the charge-controlling resin A was dissolved in the MEK, to thereby form a resin solution. The resin solution thus obtained was mixed with 100 parts of distilled water, and under the same stirring conditions and the same solvent removing conditions as those for the charge suspension A, a charge suspension B was formed.

The charge suspension B thus obtained was found to have a solid content of 20.5%, the charge-controlling resin (microparticles) was found to have a volume-average particle size of 122 nm as a median size, and the volume of the quaternary ammonium salt-containing group existing on the surface of the charge-controlling resin (microparticles) was found to be $1.0\times10^{-4}$ mol/g.

(Preparation of Charge Suspension C)

The same procedures as in the preparation of the charge suspension B were performed except that the rotation speed of the homogenizer was set to 8000 rpm (tip circumferential velocity of 5.2 m/s), to thereby prepare a charge suspension C.

The charge suspension C thus obtained was found to have a solid content of 20.0%, the charge-controlling resin (microparticles) was found to have a volume-average particle size of 230 nm as a median size, and the volume of the quaternary ammonium salt-containing group existing on the surface of the charge-controlling resin (microparticles) was found to be $6.0\times10^{-5}$ mol/g.

(Preparation of Charge Suspension D)

82.5 parts of MEK and 17.5 parts of the charge-controlling resin B were mixed with stirring, and the charge-controlling resin B was dissolved in the MEK, to thereby form a resin solution.

The resin solution was then mixed with distilled water (100 parts), and the mixture was agitated using a homogenizer at a rotation speed of 20000 rpm (tip circumferential velocity of 13.1 m/s) for 20 minutes to emulsify the mixture. The obtained emulsion was transferred to a 1 L separable flask, and while nitrogen was blown into the gas phase, the content of the flask was heated with stirring at 60° C. for 45 minutes to remove the MEK, whereby a charge suspension D was formed.

The charge suspension D thus obtained was found to have a solid content of 13.7%, the charge-controlling resin (microparticles) was found to have a volume-average particle size of 150 nm as a median size, and the volume of the quaternary ammonium salt-containing group existing on the surface of the charge-controlling resin (microparticles) was found to be $5.1\times10^{-5}$ mol/g.

(Preparation of Charge Suspension E)

The same procedures as in the preparation of the charge suspension B were performed except that the charge-controlling resin C was used instead of the charge-controlling resin A, to thereby prepare a charge suspension E.

The charge suspension E thus obtained was found to have a solid content of 20.0%, the charge-controlling resin (microparticles) was found to have a volume-average particle size of 170 nm as a median size, and the volume of the quaternary ammonium salt-containing group existing on the surface of the charge-controlling resin (microparticles) was found to be $6.0\times10^{-4}$ mol/g.

(Preparation of Charge Suspension F)

85 parts of MEK and 15 parts of the charge-controlling resin D were mixed with stirring, and the charge-controlling resin D was dissolved in the MEK, to thereby form a resin solution.

The resin solution was then mixed with 100 parts of distilled water, and the mixture was agitated using a homogenizer at a rotation speed of 16000 rpm (tip circumferential velocity of 10.5 m/s) for 30 minutes to emulsify the mixture. The obtained emulsion was transferred to a 1 L separable flask, and while nitrogen was blown into the gas phase, the content of the flask was heated with stirring at 60° C. for 45 minutes to remove the MEK, whereby a charge suspension F was formed.

The charge suspension F thus obtained was found to have a solid content of 16.0%, the charge-controlling resin (microparticles) was found to have a volume-average particle size of 72 nm as a median size, and the volume of the quaternary ammonium salt-containing group existing on the surface of the charge-controlling resin (microparticles) was found to be $1.2\times10^{-4}$ mol/g.

(Preparation of Charge Suspension G)

70 parts of MEK was mixed with 100 parts of distilled water, and, thereafter, 30 parts of the charge-controlling resin A was added to the mixture. The resulting mixture was then agitated using a homogenizer at a rotation speed of 8000 rpm (tip circumferential velocity of 7.2 m/s) for 30 minutes to emulsify the mixture. The obtained emulsion was transferred to a 1 L separable flask, and while nitrogen was blown into the gas phase, the content of the flask was heated with stirring at 60° C. for 45 minutes to remove the MEK, whereby a charge suspension G was formed.

The charge suspension G thus obtained was found to have a solid content of 30.2%, the charge-controlling resin (microparticles) was found to have a volume-average particle size of 320 nm as a median size, and the volume of the quaternary ammonium salt-containing group existing on the surface of the charge-controlling resin (microparticles) was found to be $4.2\times10^{-5}$ mol/g.

(Preparation of Charge Suspension H)

80 parts of MEK and 20 parts of the charge-controlling resin B were mixed with stirring, and the charge-controlling resin B was dissolved in the MEK, to thereby form a resin solution.

The resin solution was then mixed with 100 parts of distilled water, and the mixture was agitated using a homogenizer at a rotation speed of 16000 rpm (tip circumferential velocity of 10.5 m/s) for 20 minutes to emulsify the mixture. The obtained emulsion was transferred to a 1 L separable flask, and while nitrogen was blown into the gas phase, the content of the flask was heated with stirring at 60° C. for 45 minutes to remove the MEK, whereby a charge suspension H was formed.

The charge suspension H thus obtained was found to have a solid content of 15.0%, the charge-controlling resin (microparticles) was found to have a volume-average particle size of 210 nm as a median size, and the volume of the quaternary ammonium salt-containing group existing on the surface of the charge-controlling resin (microparticles) was found to be $3.1\times10^{-5}$ mol/g.

(Preparation of Charge Suspension I)

82.5 parts of MEK and 17.5 parts of the charge-controlling resin C were mixed with stirring, and the charge-controlling resin C was dissolved in the MEK, to thereby form a resin solution.

The resin solution was mixed with 100 parts of distilled water, and the mixture was agitated using a homogenizer at a rotation speed of 20000 rpm (tip circumferential velocity of 13.1 m/s) for 30 minutes to emulsify the mixture. The obtained emulsion was transferred to a 1 L separable flask, and while nitrogen was blown into the gas phase, the content of the flask was heated with stirring at 60° C. for 45 minutes to remove the MEK. However, aggregation occurred in the middle of the removal process and some coarse particles were thus produced. To cope with this situation, the charge suspension was filtered under suction (membrane filter made of cellulose acetate (filter pore size: 3.0 μm; manufactured by ADVANTEST CORPORATION)). The filtrate thus obtained was considered as a charge suspension I.

The charge suspension I thus obtained was found to have a solid content of 14.2%, the charge-controlling resin (microparticles) was found to have a volume-average particle size of 105 nm as a median size, and the volume of the quaternary ammonium salt-containing group existing on the surface of the charge-controlling resin (microparticles) was found to be $8.2\times10^{-4}$ mol/g.

3) Preparation of the Suspension of Toner Base Particles (Hereinafter Referred to as Base Particle Suspension)

(Preparation of the Base Particle Suspension A)

200 parts of polyester resin FC1565 (Tg: 64° C.; Mn (number-average molecular weight): 5000; Mw (weight-average molecular weight): 98000; gel content: 1.5 wt. %; acid value: 6.1 KOH mg/g; manufactured by Mitsubishi Rayon Co., Ltd.), 10 parts of carbon black #260 (manufactured by Mitsubishi Chemical Corporation), 10 parts of paraffin wax HNP-9 (melting point: 75.6° C.; manufactured by NIPPON SEIRO CO., LTD.), 800 parts of MEK were mixed, and the mixture was agitated using a homogenizer (shaft 25F; the same applies to the following) at a rotation speed of 16000 rpm for 20 minutes, whereby a resin solution was prepared.

900 parts of the resin solution, 900 parts of distilled water, and 9.0 parts of a 1N sodium hydroxide aqueous solution were mixed, and the mixture was agitated using a homogenizer at a rotation speed of 16000 rpm for 20 minutes to emulsify the mixture. The obtained emulsion was transferred to a 2 L separable flask, and while nitrogen was blown into the gas phase, the content of the flask was heated with stirring at 70° C. for 150 minutes to remove the MEK, whereby an aqueous dispersion was formed. The microparticles in the aqueous dispersion were found to have a volume-average particle size of 280 nm as a median size. (At this time, the volume-average particle size was determined using a Microtrac particle size analyzer while the refractive index of the solvent and that of the dispersion was set at 1.33 and 1.92, respectively.)

Subsequently, the aqueous dispersion was diluted with distilled water so as to have a solid content of 10%. 3.2 parts of a nonionic surfactant (NOIGEN XL50; manufactured by DAI-ICHI KOGYO SEIYAKU CO., LTD.) was added to 1600 parts of the dilute aqueous dispersion, and 40 parts of 0.2N aluminium chloride as a flocculent was then added to the mixture. The resulting mixture was subjected to high speed mixing using a homogenizer at a rotation speed of 8000 rpm.

The mixture was transferred to a 2 L separable flask, and the content of the flask was heated to 43° C. while being subjected to agitation with a turbine-mixer having 6 flat blades (diameter: 75 mm) at a rotation speed of 350 rpm, whereby the microparticles were aggregated. Thereafter, 40 parts of a 0.2N sodium hydroxide aqueous solution as an aggregation terminator and 1.6 parts of NOIGEN XL50 were added to the flask, and the resulting mixture was then heated to 90° C. and agitated for about 6 hours.

After cooling, 4 parts of 1N hydrochloric acid was added to the aqueous dispersion and the agitation was performed for 1 hour. Thereafter, the agitated mixture was subjected to suction filtration and the resultant was again suspended in distilled water, whereby a base particle suspension A having a solid content of 10% was formed. The toner base particles in the base-particle suspension A were confirmed to be in a spherical shape. The toner base particles had a volume-average particle size of 8.3 μm as a median size and a Tg of 56° C.

The volume-average particle size was determined as follows. The following toner base particles were determined in the same manner.

Volume-average particle size: A particle size analyzer (COULTER MULTISIZER II; manufactured by Beckman Coulter, Inc.) was used. The volume-average particle size was determined using the analyzer with an aperture diameter of 100 μm.

(Preparation of the Base Particle Suspension B)

200 parts of polyester resin FC1233 (Tg: 66° C.; Mn: 5200; Mw: 105000; gel content: 10%; acid value: 7.1 KOH mg/g; manufactured by Mitsubishi Rayon Co., Ltd.), 10 parts of carbon black #260 (manufactured by Mitsubishi Chemical Corporation), 10 parts of a polyfunctional ester compound, CLOVAX 500-5S (melting point: 75.2° C.; manufacture by Nippon Kasei Chemical Co., Ltd.), and 800 parts of MEK were mixed, and the mixture was agitated using a homogenizer at a rotation speed of 16000 rpm for 60 minutes, whereby a resin solution was prepared.

800 parts of the resin solution, 800 parts of distilled water, and 8.8 parts of a 1N sodium hydroxide aqueous solution were mixed, and the mixture was agitated using a homogenizer at a rotation speed of 16000 rpm for 20 minutes to emulsify the mixture. The obtained emulsion was transferred to a 2 L separable flask, and while nitrogen was blown into the gas phase, the content of the flask was heated with stirring at 70° C. for 150 minutes to remove the MEK, whereby an aqueous dispersion was formed. The microparticles in the aqueous dispersion were found to have a volume-average particle size of 330 nm as a median size.

Subsequently, the aqueous dispersion was diluted with distilled water so as to have a solid content of 10%. 3.2 parts of a nonionic surfactant (NOIGEN XL50; manufactured by DAI-ICHI KOGYO SEIYAKU CO., LTD.) was added to 1600 parts of the dilute aqueous dispersion, and 60 parts of 1N magnesium chloride as a flocculent was then added to the mixture. The resulting mixture was subjected to high speed mixing using a homogenizer at a rotation speed of 8000 rpm.

The mixed dispersion was transferred to a 2 L separable flask, and the content of the flask was heated to 45° C. while being subjected to agitation with a turbine-mixer having 6 flat blades (diameter: 75 mm) at a rotation speed of 350 rpm, whereby the microparticles were aggregated. Thereafter, 50 parts of a 0.2N sodium hydroxide aqueous solution as an aggregation terminator and 2.0 parts of NOIGEN XL50 were added to the flask, and the resulting mixture was then heated to 90° C. and agitated for about 6 hours.

After cooling, 4.4 parts of 1N-hydrochloric acid was added to the aqueous dispersion and the agitation was performed for 1 hour. Thereafter, the agitated mixture was subjected to suction filtration and the resultant was again suspended in distilled water, whereby a base particle suspension B having a solid content of 10% was formed. The toner base particles in the base particle suspension B were confirmed to be in a slightly distorted shape (a potato-like shape). The toner base particles had a volume-average particle size of 9.0 μm as a median size and a Tg of 57° C.

(Preparation of the Base Particle Suspension C)

32 parts of polyester resin XPE2444 (Tg: 70° C.; Mn: 2400; Mw: 6100; gel content: 0%; acid value: 3.7 KOH mg/g; manufactured by Mitsui Chemicals Inc.), 128 parts of XPE2443 (Tg: 75° C.; Mn: 4400; Mw: 81300; gel content: 17%; acid value: 2.0 KOH mg/g; manufactured by Mitsui Chemicals Inc.), 320 parts of ethyl acetate, 8 parts of carbon black #260 (manufactured by Mitsubishi Chemical Corporation), 8 parts of paraffin wax HNP-9 were mixed, and the mixture was agitated using a homogenizer at a rotation speed of 16000 rpm for 60 minutes, whereby a resin solution was prepared.

1104 parts of distilled water, 3.2 parts of NOIGEN XL50, and 16 parts of an aqueous dispersion of calciumphosphate (SUPATITE; solid content: 10.2%; manufactured by Nippon Chemical Industrial Co., Ltd.) were provided in a separate vessel and then mixed with a resin solution. Thereafter, the mixture was agitated using a high-speed agitator CLEAR MIX (Type: S942; rotor: R1; screen: S1.5-24; manufactured by M Technique) at 10000 rpm for 20 minutes to emulsify the mixture.

The resulting emulsion was transferred to a 2 L separable flask, and the content of the flask was heated under reduced pressure at 60° C. while being subjected to agitation with a turbine-mixer having 6 flat blades (diameter: 75 mm) at a rotation speed of 130 rpm to vaporize the solvent in the emulsion, whereby solid particles were formed. The solid particles were filtered once, and the filtered particles were then dispersed in 600 parts of a 0.06N hydrochloric acid aqueous solution. The dispersed solution was then agitated for about 2 hours to dissolve and remove the inorganic dispersing agent. The solution was again filtered, and the resultant was then suspended in distilled water, whereby a base particle suspension C having a solid content of 10% was formed. The toner base particles in the base-particle suspension C were confirmed to be in a spherical shape. The toner base particles had a volume-average particle size of 7.5 μm as a median size and a Tg of 58° C.

(Preparation of the Base Particle Suspension D)

100 parts by weight of polyester resin XPE2443, 5 parts by weight of carbon black #260, and 4 parts by weight of polypropylene wax VISCOL 660P (melting point: 142° C.; manufactured by Sanyo Chemical Industries, Ltd.) were mixed using a HENSCHEL MIXER high-speed agitator. Thereafter, the mixture was melt-kneaded using a twin-screw kneading extruder to roughly pulverize the mixture. The roughly pulverized product was then pulverized and classified to thereby form toner base particles. The toner base particles thus obtained were dispersed in a 0.05% aqueous solution of NOIGEN XL50, whereby a base particle suspension D having a solid content of 10% was formed. The toner base particles had a volume-average particle size of 8.5 μm as a median size and a Tg of 65° C.

(Preparation of Toner A)

1600 parts of the base particle suspension A was put in a 2 L separable flask, and the content of the flask was subjected to agitation with a turbine-mixer having 6 flat blades (diameter: 75 mm) at a rotation speed of 150 rpm.

Subsequently, the charge suspension A was supplied into the separable flask so as to have a solid content (i.e., the charge-controlling resin) of 3 parts, based on 100 parts of the solid content (i.e., the toner base particles) in the base particle suspension A.

After the supply, the resulting mixture was heated to a solution temperature of 60° C. Ten minutes after the solution temperature reaches 60° C., the mixture was taken out from the flask and then cooled. Thereafter, the cooled mixture was subjected to suction filtration. The filtered mixture was again washed with a sufficient amount of distilled water, and the washed mixture was then filtered and dried, to thereby produce a toner without containing external additive.

The weight of the filtrate was determined and the weight of the solid content in the filtrate was calculated. The calculated value was then deducted from the weight of the solid content of the charge suspension A in the mixture, thereby calculating the weight of the charge-controlling resin fixed on the toner base particles. The amount of the fixed charge-controlling resin was 1.1 parts, based on 100 parts of the toner base particles.

Subsequently, 1.5 parts of a hydrophobic silica HVK2150 (manufactured by Clariant) and 2.25 parts of NA50H (manufactured by AEROSIL) were mixed with 150 parts of the toner thus obtained, and the mixture was agitated using a MECHANOMILL (manufactured by OKADA SEIKO CO., LTD.) at a rotation speed of 2500 rpm for 3 minutes, whereby the toner was externally added. Coarse aggregates of silica were removed from the externally added toner through a sieve, whereby a non-magnetic single-component, positively chargeable toner A was prepared.

The volume-average particle size (median size), CV value, degree of dispersion, and average circularity of the toner A thus obtained were determined. The results are shown in Table 1. A particle size analyzer, COULTER MULTISIZER II (aperture diameter: 100 μm; manufactured by Beckman Coulter, Inc.), was used to determine the volume-average particle size (median size), the CV value, and the degree of dispersion. In addition, a flow particle image analyzer, FPIA-3000 (manufactured by SYSMEX Corporation), was used to determine the average circularity. 0.1 to 0.5 g of a toner was added to an aqueous solution obtained by mixing 30 to 60 ml of distilled water with several drops of surfactants in a 100-ml beaker. The resulting mixture was dispersed using a ultrasonic dispersing apparatus for 1 to 5 minutes to form a dispersion. The dispersion was then supplied to the FPIA-3000 using a dropping pipette. The volume of the supplied dispersion was appropriately adjusted so that the number of measuring particles was in the range of 10000 to 30000 pieces, and the measurement was performed.

(Preparation of Toners B to L)

The same procedures as in the preparation of the toner A were performed except that the parameters of base particle suspension, charge suspension, mixed amount (solid content of the charge suspension based on 100 parts of the solid content of base particle suspension), fixed amount, treatment temperature, and treatment time were set as shown in Table 1, to thereby produce non-magnetic single-component, positively chargeable toners B to L. The volume-average particle size (median size), CV value, degree of dispersion, and average circularity of the toners B to L thus obtained were determined in the same manner as above. The results are shown in Table 1.

(Evaluation of Toners)

A laser printer, HL-1850 manufactured by Brother Industries, Ltd. was used to evaluate fog, solid supply performance, and ghost. The results are shown in Table 1.

1) Fog

Under the environment of 25° C./55% RH, a solid white image was outputted on 10 sheets of A4 paper, and the fog was then evaluated.

The fog was evaluated in the following procedure. A toner deposited on the surface of the photosensitive drum was transferred to an adhesive tape. The adhesive tape was then attached to Xerox 4200 paper. Thereafter, an adhesive tape without transferred toners was prepared as a reference, and the fog was evaluated by difference between whitenesses of these adhesive tapes.

The difference in whiteness was calculated from difference between whiteness of a non-toner-transferred adhesive tape (Y0) and whiteness of a toner-transferred adhesive tape (Y1), i.e., $\Delta Y = Y0 - Y1$, while the whiteness values were determined using a densitometer (TC-6DS manufactured by Tokyo Denshoku Co., Ltd.).

2) Solid Supply Performance

Under the environment of 25° C./55% RH, a solid black image was outputted on one page of A4 paper, and the difference in optical density (ΔOD) between a leading end portion of the printed sheet and an intermediate portion thereof was specified as an index of solid supply performance. The optical density was determined using a photographic densitometer (Macbeth TD904).

When the determined value is equal to or more than 0.3, the density difference can be clearly observed. The solid supply performance is said to be correlated with flowability of the toner and charge rising performance.

3) Ghost

Under the environment of 25° C./55% RH, an A4 image having a solid black portion by the first rotation of the photosensitive drum and a halftone portion on the subsequent portion was outputted, and the presence or absence of generation of ghost was evaluated.

In Table 1, "A" denotes that the half-tone portion has constant image density, and the density difference was hardly observed, and "B" denotes that the difference between the halftone image density by one rotation of the drum immediately after the solid black and the halftone image density on the subsequent portion is clearly observed.

TABLE 1

| | | | Charging Suspension | | | | | |
|---|---|---|---|---|---|---|---|---|
| | | Base Particle Suspension | No. | Volume of Positive Polar Group X10-E05 (mol/g) | Mixed Amount (Part) | Fixed Amount (Part) | Treatment Temperature (° C.) | Treatment Time (min) |
| Ex. 1 | Toner A | A | A | 15 | 3 | 1.1 | 60 | 10 |
| Ex. 2 | Toner B | A | C | 6 | 2 | 1.9 | 58 | 10 |
| Ex. 3 | Toner C | A | E | 60 | 2 | 0.6 | 58 | 10 |
| Ex. 4 | Toner D | B | B | 10 | 3 | 2.8 | 60 | 10 |
| Ex. 5 | Toner E | B | E | 60 | 3 | 0.9 | 60 | 10 |
| Ex. 6 | Toner F | C | C | 6 | 3 | 2.2 | 65 | 10 |
| Ex. 7 | Toner G | C | D | 5.1 | 2 | 1.5 | 58 | 10 |
| Ex. 8 | Toner H | D | F | 12 | 3 | 2.5 | 66 | 10 |
| Comp. Ex. 1 | Toner I | A | G | 4.2 | 4 | 0.8 | 58 | 10 |
| Comp. Ex. 2 | Toner J | A | I | 82 | 2 | 0.5 | 58 | 10 |
| Comp. Ex. 3 | Toner K | B | H | 3.1 | 3 | 2.6 | 60 | 10 |
| Comp. Ex. 4 | Toner L | C | H | 3.1 | 3 | 0.9 | 58 | 10 |

| | | Volume-Average Particle Size (Median size: μm) | CV Value (%) | Degree of Dispersion | Average Circularity | Fog (ΔY) | Solid Supply Performance (ΔOD) | Ghost |
|---|---|---|---|---|---|---|---|---|
| Ex. 1 | Toner A | 8.3 | 24 | 1.17 | 0.992 | 0.2 | 0.01 | A |
| Ex. 2 | Toner B | 8.4 | 24.5 | 1.18 | 0.992 | 0.8 | 0.06 | A |
| Ex. 3 | Toner C | 8.3 | 24 | 1.18 | 0.992 | 0.1 | 0.01 | A |
| Ex. 4 | Toner D | 9 | 27 | 1.2 | 0.945 | 0.3 | 0.03 | A |
| Ex. 5 | Toner E | 9.1 | 27.5 | 1.21 | 0.945 | 0.1 | 0.02 | A |
| Ex. 6 | Toner F | 7.5 | 29.1 | 1.25 | 0.991 | 0.6 | 0.09 | A |
| Ex. 7 | Toner G | 7.6 | 29.2 | 1.25 | 0.991 | 0.3 | 0.05 | A |
| Ex. 8 | Toner H | 8.5 | 30.2 | 1.3 | 0.912 | 1.2 | 0.1 | A |
| Comp. Ex. 1 | Toner I | 8.5 | 24.3 | 1.18 | 0.992 | 5.2 | 0.05 | B |
| Comp. Ex. 2 | Toner J | 8.5 | 24.2 | 1.18 | 0.992 | 9.8 | 0.2 | B |
| Comp. Ex. 3 | Toner K | 9.2 | 27.5 | 1.21 | 0.945 | 5.6 | 0.08 | B |
| Comp. Ex. 4 | Toner L | 7.7 | 29.5 | 1.26 | 0.991 | 5.3 | 0.1 | B |

The aforementioned embodiments are shown for illustration and explanation purposes, and are not intended to limit the present invention by correctly following this disclosure. Various modifications and alterations can be made in light of the foregoing explanation, and can be obtained by implementing the present invention. The present embodiments were chosen and described to provide the essence and practical application of the present invention to thereby enable those skilled in the art to utilize the present invention in various embodiments and various modifications suited to the particular use contemplated. The scope of the present invention should be defined by the appended claims and equivalents thereof.

What is claimed is:

1. A method for producing a positively chargeable toner comprising the steps of:

mixing and emulsifying a charge-controlling resin having a positive polar group, an organic solvent and an aqueous medium to form an emulsion, and then removing the organic solvent from the emulsion, to thereby form a suspension of the charge-controlling resin having a positive polar group in the range of $5.0\times10^{-5}$ to $6.0\times10^{-4}$ mol/g;

mixing the suspension of the charge-controlling agent with a suspension of toner base particles containing a binder resin and a colorant, to thereby form a mixture; and heating the mixture containing the suspension of the toner base particles and the suspension of the charge-controlling resin, to thereby fix the charge-controlling resin on surfaces of the toner base particles.

2. A method for producing a positively chargeable toner according to claim 1, wherein the toner base particles have a surface potential with a negative polarity in a state of being suspended in an aqueous medium.

3. A method for producing a positively chargeable toner according to claim 1, wherein the binder resin is a polyester resin.

4. A method for producing a positively chargeable toner according to claim 1, wherein the positive polar group is a quaternary ammonium salt.

5. A method for producing a positively chargeable toner according to claim 1, wherein the positively chargeable toner is a non-magnetic single-component toner.

* * * * *